US009381657B2

(12) United States Patent
Xu et al.

(10) Patent No.: US 9,381,657 B2
(45) Date of Patent: Jul. 5, 2016

(54) REPLACEABLE FLUID DISPENSING CARTRIDGE

(75) Inventors: Xiaolan Xu, Singapore (SG); Kevin James Wain, Reading (GB)

(73) Assignee: The Gillette Company, Boston, MA (US)

( * ) Notice: Subject to any disclaimer, the term of this patent is extended or adjusted under 35 U.S.C. 154(b) by 632 days.

(21) Appl. No.: 13/613,133

(22) Filed: Sep. 13, 2012

(65) Prior Publication Data

US 2013/0145626 A1 Jun. 13, 2013

(30) Foreign Application Priority Data

Dec. 9, 2011 (WO) ..... PCT/CN2011/083780

(51) Int. Cl.

| | |
|---|---|
| ***B26B 21/40*** | (2006.01) |
| ***B26B 21/00*** | (2006.01) |
| ***B26B 21/52*** | (2006.01) |
| ***B26B 21/44*** | (2006.01) |

(52) U.S. Cl.

CPC ..... *B26B 21/446* (2013.01); *B26B 21/521* (2013.01); *Y10T 29/4998* (2015.01)

(58) Field of Classification Search

CPC ..... B62B 21/4018; B62B 21/4025; B62B 21/4031; B62B 21/521; B62B 21/52; B62B 21/446; B23P 11/00; B23P 11/02; Y10T 29/49876; Y10T 29/49895; Y10T 137/0402; Y10T 29/4998

USPC ..... 30/41, 32, 74.1, 77–83, 47–51, 30/526–536, 41.5; 137/15.01, 315.01; 29/527.1

See application file for complete search history.

(56) References Cited

U.S. PATENT DOCUMENTS

| | | | |
|---|---|---|---|
| 4,023,269 | A | 5/1977 | Lopez, Jr. |
| 4,077,119 | A | 3/1978 | Sellera |
| 4,562,644 | A | 1/1986 | Hitchens |
| 5,134,775 | A | 8/1992 | Althaus et al. |
| 5,283,952 | A | 2/1994 | Mock et al. |
| 5,993,180 | A | 11/1999 | Westerhof et al. |

(Continued)

FOREIGN PATENT DOCUMENTS

| | | |
|---|---|---|
| CN | 201960596 U | 9/2011 |
| GB | 2 282 773 | 4/1995 |

(Continued)

OTHER PUBLICATIONS

U.S. Appl. No. 13/585,910, filed Aug. 15, 2012, Paul M. Jessemey et al.

(Continued)

*Primary Examiner* — Ghassem Alie

(74) *Attorney, Agent, or Firm* — Ronald Terk Sia; Kevin C. Johnson; Steven W. Miller

(57) ABSTRACT

A replaceable fluid dispensing cartridge for a liquid dispensing razor having a fluid interconnect member with a pivotable support member and a base member with a fluid port and an engagement surface for removably and fixedly mating to a corresponding engagement member of a handle. A cartridge housing is mounted to the pivotable support member. The cartridge housing has a guard, a cap, and at least one blade between the cap and the guard. A fluid applicator defining an opening is fixedly joined to the interconnect member.

13 Claims, 8 Drawing Sheets

(56) References Cited

U.S. PATENT DOCUMENTS

| | | | | |
|---|---|---|---|---|
| 6,594,905 | B2 | 7/2003 | Fürst et al. | |
| 6,665,937 | B2 | 12/2003 | Fürst et al. | |
| 6,763,590 | B2 | 7/2004 | Guimont et al. | |
| 6,807,739 | B2 | 10/2004 | Follo | |
| 6,886,254 | B1 | 5/2005 | Pennella | |
| 6,910,274 | B1 | 6/2005 | Pennella et al. | |
| 6,925,716 | B2 | 8/2005 | Bressler et al. | |
| 6,964,097 | B2 | 11/2005 | Franzini et al. | |
| 6,986,207 | B2 | 1/2006 | Selek | |
| 7,043,841 | B2 | 5/2006 | Franzini et al. | |
| 7,121,754 | B2 | 10/2006 | Bressler et al. | |
| 7,137,203 | B2 | 11/2006 | Bressler et al. | |
| 7,200,936 | B2 | 4/2007 | Coffin et al. | |
| 7,234,239 | B2 | 6/2007 | Saito et al. | |
| 7,997,454 | B2 | 8/2011 | LaFlamme et al. | |
| 8,132,696 | B2 | 3/2012 | Mileti | |
| 8,220,156 | B2 | 7/2012 | Forsdike et al. | |
| 8,327,544 | B2 | 12/2012 | De Klerk et al. | |
| 8,438,735 | B2 | 5/2013 | De Klerk | |
| 2005/0138814 | A1 | 6/2005 | Pennella et al. | |
| 2008/0307653 | A1 | 12/2008 | Wattam | |
| 2008/0307660 | A1 | 12/2008 | Clarke | |
| 2009/0083982 | A1* | 4/2009 | Forsdike | 30/34.2 |
| 2009/0183371 | A1 | 7/2009 | Mileti et al. | |
| 2009/0205670 | A1 | 8/2009 | Fierus et al. | |
| 2010/0095529 | A1 | 4/2010 | Hawes et al. | |
| 2010/0095530 | A1 | 4/2010 | De Klerk et al. | |
| 2010/0115774 | A1* | 5/2010 | De Klerk | 30/41.5 |
| 2010/0236071 | A1 | 9/2010 | Szczepanowski et al. | |
| 2011/0067245 | A1* | 3/2011 | Bridges | B26B 21/222 30/77 |
| 2011/0219621 | A1 | 9/2011 | Royle et al. | |
| 2011/0219624 | A1 | 9/2011 | Rockell et al. | |
| 2012/0102743 | A1 | 5/2012 | Wain et al. | |
| 2012/0102750 | A1 | 5/2012 | Wain et al. | |
| 2012/0102761 | A1* | 5/2012 | Jessemey | B26B 21/4018 30/346.58 |
| 2013/0067714 | A1 | 3/2013 | Szczepanowski et al. | |

FOREIGN PATENT DOCUMENTS

| | | |
|---|---|---|
| JP | 10-165668 | 6/1998 |
| JP | 2005-169048 | 6/2005 |
| JP | 2005-199020 | 7/2005 |
| WO | WO 2011/073858 | 6/2011 |
| WO | WO 2012/058214 | 5/2012 |

OTHER PUBLICATIONS

U.S. Appl. No. 13/613,120, filed Sep. 13, 2012, Xiaolan Xu et al.

U.S. Appl. No. 13/586,066, filed Aug. 15, 2012, Kevin J. Wain.

U.S. Appl. No. 13/586,097, filed Aug. 15, 2012, Lee Burrowes et al.

PCT Notification of Transmittal of Supplementary International Search Report or Declaration for PCT/CN2011/083780 (P&G Case Z-8638), dated Nov. 3, 2014.

* cited by examiner

REPLACEABLE FLUID DISPENSING CARTRIDGE

FIELD OF THE INVENTION

The present invention relates to personal-care appliances in general, and more particularly, to fluid dispensing shaving razors having a replaceable fluid dispensing cartridge for shaving and dispersing fluid to a surface of the skin and/or hair.

BACKGROUND OF THE INVENTION

Skin care can be of particular importance in improving or enhancing the appearance of men and women. Various products and methods can be used to care for skin. For example, exfoliant scrubs, cleansers, and lotions are sometimes used to maintain healthy-looking skin Exfoliant scrubs can be used to remove dead skin cells from the surface of the skin, which can give the skin an improved tone. Soaps and other cleansers can be used to remove dirt and excess oil from the skin, which can help prevent clogging of pores. Consequently, acne and other types of skin blemishes can be prevented in some cases. Lotions and various other topical ointments can also be used to deliver nutrients and/or moisturizers to the skin in an effort to improve the appearance and/or the health of the skin. Other types of cosmetic products (e.g., creams and lotions) or drug actives are sometimes used in an attempt to eliminate wrinkling and other signs of aging.

The shaving process typically includes the application of a shaving aid material (e.g., shaving cream) to the surface and the separate step of shaving the hair using a razor assembly. The shaving aid material oftentimes includes at least one suitable agent (e.g., a lubricating agent, a drag-reducing agent, a depilatory agent, etc.) that enhances the shaving process. Most consumers find this type of preparation to be rather inconvenient because of the need for multiple shaving products, e.g., a wet shaving razor and a skin preparation product, as well as the undesirable necessity for multiple application steps during the wet shaving process. Furthermore, this process can be messy and requires the consumer rinse their hands after applying the shave gel. This multi-step process also results in an overall extended shaving experience which most consumers do not prefer given typical morning hygiene routines. It may, however, be desirable to apply liquids of other kinds to the skin before, during, or after shaving. It has been found that especially in the case of males who shave facial hair, it is important to provide a shave preparation of some sort prior to shaving in order to adequately hydrate the coarser facial hairs to allow for an easier and closer shave. It has been suggested in the literature to provide a shaving razor with a built in dispensing unit that releases a fluid (e.g., shaving aid) from a fluid container. However, these razors do not provide for simple and intuitive replacement and/or loading of a fluid dispensing cartridge.

SUMMARY OF THE INVENTION

In one aspect, the invention features, in general, a replaceable fluid dispensing cartridge for a liquid dispensing razor having a fluid interconnect member with a pivotable support member and a base member with a fluid port and an engagement surface for removably and fixedly mating to a corresponding engagement member of a handle. A cartridge housing is mounted to the pivotable support member. The cartridge housing has a guard, a cap, and at least one blade between the cap and the guard. A fluid applicator defining an opening is fixedly joined to the interconnect member.

The details of one or more embodiments of the invention are set forth in the accompanying drawings and the description below. It is understood that certain embodiments may combine elements or components of the invention which are disclosed in general, but not expressly exemplified or claimed in combination, unless otherwise stated herein. Other features and advantages of the invention will be apparent from the description and drawings, and from the claims.

DETAILED DESCRIPTION OF THE INVENTION

The present disclosure is not limited to wet shaving razors, or even razors in general. It is understood that certain aspects of the present disclosure may also be used for dry electric shaving razors that have one or more rotating or reciprocating blades or other personal care appliances (e.g., toothbrushes, depilatory applicators, epilators, or other beauty applicators). Furthermore, it is understood that certain aspects of the present disclosure may be used independently for applying a fluid.

Figure 1:
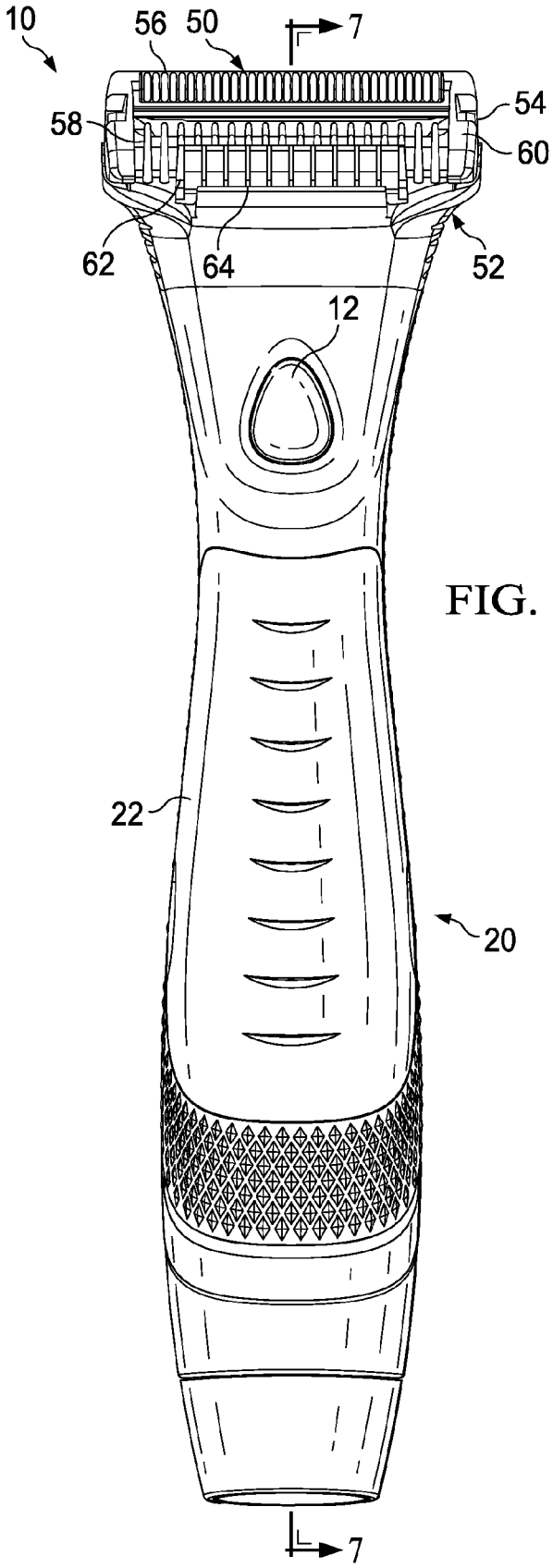
FIG. 1 is a front view of one possible embodiment of a personal-care appliance.

Referring to FIG. 1, one possible embodiment of the present disclosure is shown illustrating a front view of a personal-care appliance 10. For example, the personal-care appliance may be a fluid dispensing razor (as shown), a toothbrush, a mascara brush, or any other personal-care appliance that dispenses a fluid. As will be described in greater detail below, the personal-care appliance 10 may include a handle 20 configured to receive a pump assembly (not shown) and a fluid reservoir (not shown). The handle 20 may have a cover 22 that protects and/or conceals the pump and/or fluid reservoir within the handle 20. The cover 22 may be mounted to the handle 20 and removably secured in place (e.g., snap fit to the handle 20).

A fluid dispensing cartridge 50 may be removably mounted to the handle 20 (i.e., replaceable). The fluid dispensing cartridge 50 may include fluid interconnect member 52 having a cartridge housing 54 pivotably mounted to one end of the fluid interconnect member 52. An opposing end of the fluid interconnect member 52 may be removably mounted to one end of the handle 20. The cartridge housing 54 may have a cap 56, a guard 58 in front of the cap 56, and one or more blades 60 between the cap 56 and the guard 58. The fluid dispensing cartridge 50 may include a fluid applicator 62 for delivering one or more fluids to a surface to be treated (e.g., shaved). One end of the fluid applicator 62 may be mounted to the cartridge housing 54. For example, the fluid applicator 62 may include a guard 64 mounted to the cartridge housing 54 (e.g., the guard 58) to apply and spread the fluid to the surface to be treated (e.g., skin or hair) during a stroke of the personal-care appliance 10 against the skin An opposing end of the fluid applicator 62 may be mounted to the fluid interconnect member 52.

Figure 2:
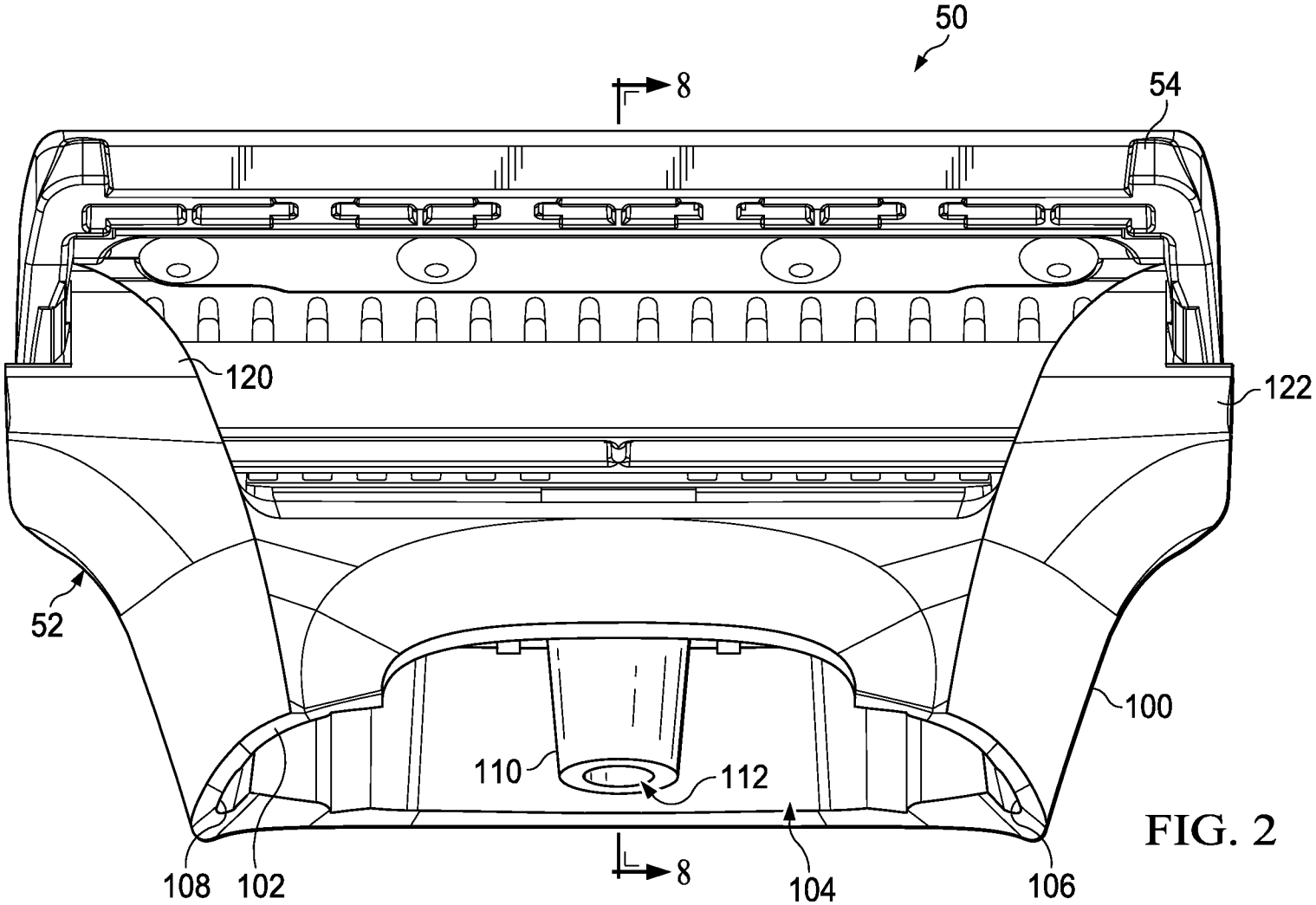
FIG. 2 is a rear view of possible embodiment of a fluid dispensing cartridge that may be incorporated into the personal-care appliance of FIG. 1

Referring to FIG. 2, a rear view of the fluid dispensing cartridge 50 is shown. The fluid interconnect member 52 may have a base member 100 with a wall 102 defines a cavity 104. The cavity 104 may be dimensioned to receive a portion of the handle 20 (not shown). In certain embodiments, the cavity 104 may be non-symmetrical to facilitate one-way mounting of the fluid dispensing cartridge 50 to the handle 20 (not shown). For example, the cavity 104 may be generally "D" shaped. The wall 102 may define one or more engagement surfaces 106 and 108 (e.g., a recesses or a protrusion). The engagement surfaces 106 and 108 may be spaced apart from a fluid port 110 that extends from the base member 100. The fluid port 110 may define an aperture 112 that extends through the fluid interconnect member 52. In certain embodiments, the fluid port 110 may be a stem that tapers inwardly away from the base member 100. The fluid interconnect member 52 may have one or more pivotable support members 120 and 122. In certain embodiments, pivotable support members 120 and 122 may be a pair of spaced apart arms that engage the cartridge housing 54.

Figure 3:
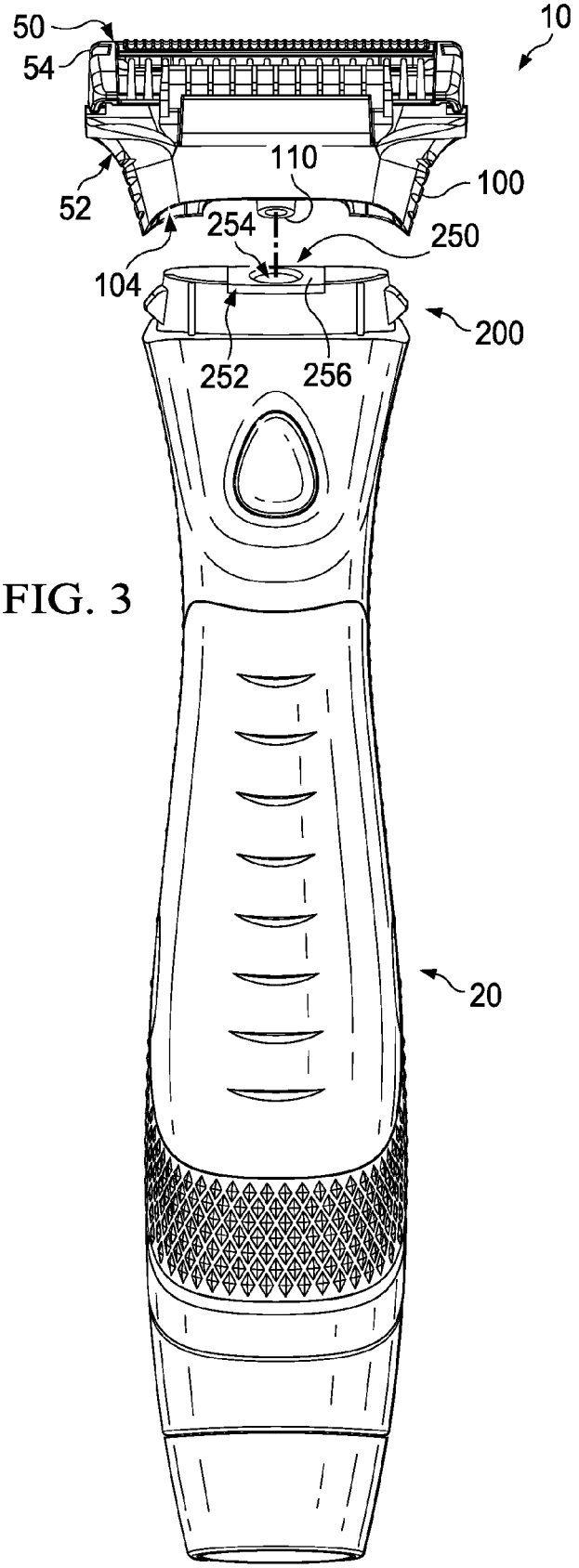
FIG. 3 is a front assembly view of the personal-care appliance of FIG. 1.

Referring FIG. 3, an assembly view of the personal-care appliance 10 is illustrated with the fluid dispensing cartridge 50 detached from the handle 20. The consumer may detach the fluid interconnect member 52 (and thus the fluid dispensing cartridge 50) from the handle 20, by simply pulling the fluid dispensing cartridge 50 away from the handle. One or more side surfaces 114 and 116 of the base member 100 may comprise a gripping member (e.g., one or more ribs 118) to facilitate the removal of the fluid dispensing cartridge 50 from the handle 20. The handle 20 may have a mechanical locking mechanism 200 spaced apart from a fluid docking member 250. The separation of the mechanical locking mechanism 200 and the fluid docking member 250 may provide a secure mechanical connection between the fluid interconnect member 52 and the handle 20 that is independent of the fluid connection. For example, relying solely on the fluid port 110 to establish a mechanical connection may not be optimal. The mechanical forces applied to the fluid port 110 may negatively impact the fluid port 110 maintaining a reliable fluid connection. The fluid docking member 250 may include a resilient member 252 (e.g., a sleeve or a ring) that defines an opening 254 extending there through that receives the fluid port providing fluid communication between the handle 20 and the fluid dispensing cartridge 50. The opening 254 may extend through a flange 256 at one end of the resilient member 252. The flange 256 may bottom out within the cavity 104 to contact the base member 100. In certain embodiments, the fluid port 110 may comprise a generally rigid polymeric material and the fluid docking member 250 may comprise a resilient elastomeric material (e.g., silicone). The more rigid material of the fluid port 110 may provide for consistent and reliable engagement with the less rigid elastomeric material of the fluid docking member 250. In addition, the elastomeric material of the fluid docking member 250 may provide for an improved fluid tight seal against the more rigid material of the fluid port 110 to prevent leakage of fluid into the handle 20.

Figure 4:
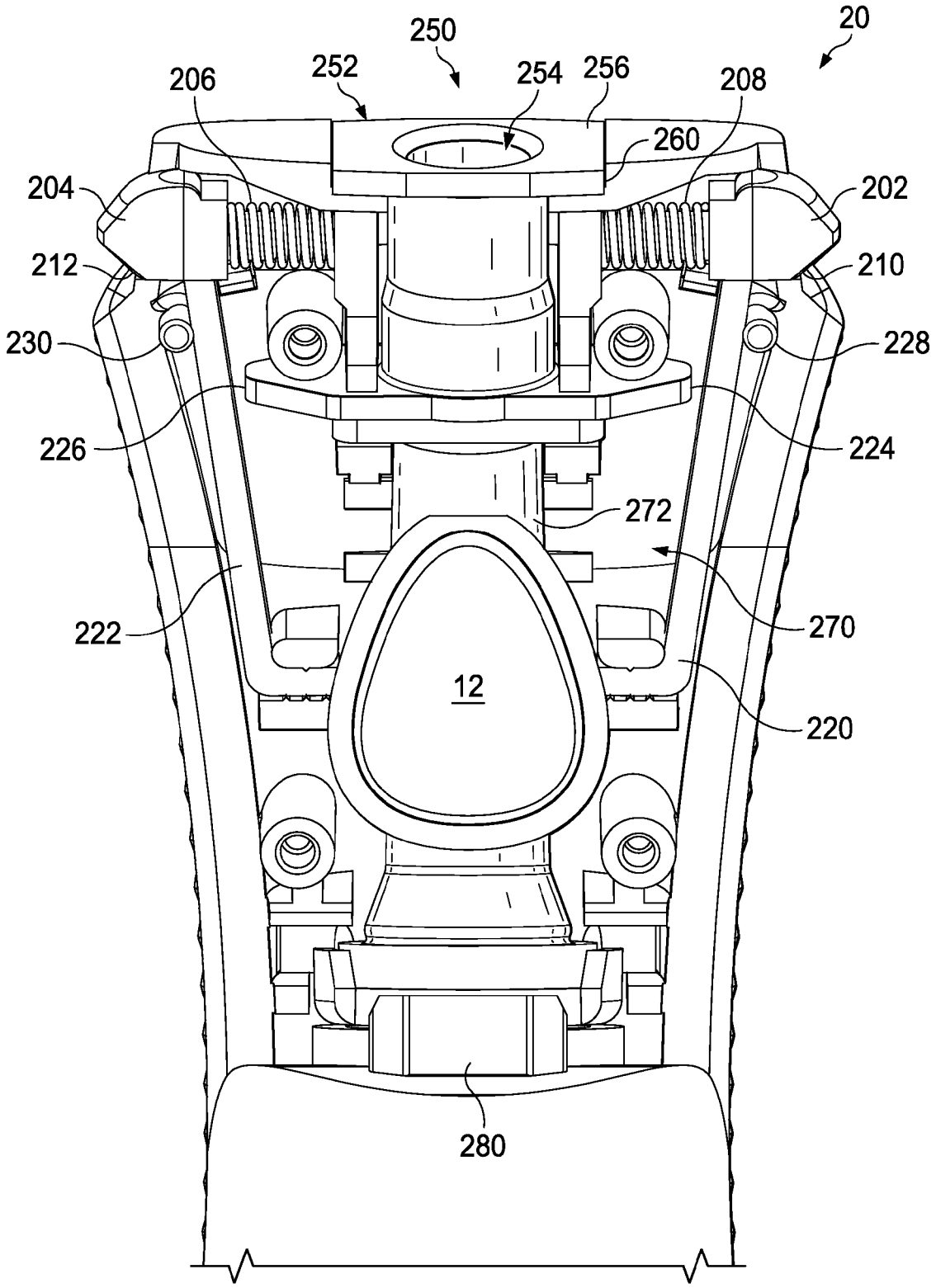
FIG. 4 is a partial front view of the personal-care appliance of FIG. 1.

Referring to FIG. 4, a partial front view of the personal-care appliance 10 is shown with a portion of the handle 20 illustrating the fluid docking member 250 and a pump assembly 270. The handle 20 may define a hollow space 225 that contains the fluid docking member 250, a pump assembly 270, and the mechanical locking mechanism 200. The flange 256 may be securely positioned within a recess 260 of the handle 20. The opening 254 of the resilient member 252 may be fluid communication with the pump assembly 270. The pump assembly 270 may include an elongated resilient tube 272 (e.g., a pump) having a pair of inner flow valves (not shown). The elongated resilient tube 272 may be in fluid communication with a fluid reservoir 280 located within the handle 20. A fluid (e.g., a lotion or gel) may be held within a fluid reservoir 280.

The mechanical locking mechanism 200 may include one or more engagement members 202 and 204 forming an outer surface of the handle 20. The engagement members 202 and 204 may move between a neutral position and a loading position. For example, a corresponding biasing member 206 and 208 may maintain the engagement members 202 and 204 in the neutral position (i.e., the engagement members 202 and 204 extend outward from a corresponding recess 210 and 212 of the handle 20). The engagement members 202 and 204 may slide within the corresponding recesses 210 and 212 of the handle 20 to engage and disengage the fluid interconnect member 52. The handle 20 may include a pair of outwardly extending arms 220 and 222 positioned within the hollow space 225. The arms 220 and 222 may be attached to the engagement members 202 and 204 for limiting the movement of the engagement members 202 and 204. For example, the arms 220 and 222 may move between a first position and a second position. In the first position, the arms 220 and 222 may contact a first stop surface 224 and 226 (e.g., a protrusion of the handle 20). In the first position, the engagement members 202 and 204 may be recessed (i.e., in the loading position). In the second position, the arms 220 and 222 may contact a corresponding second stop surface 228 and 230 (e.g., a protrusion of the handle 20). In the second position, the engagement members 202 and 204 may extend or protrude from the corresponding recesses 210 and 212 the handle 20 (i.e., in the neutral position).

Figure 5:
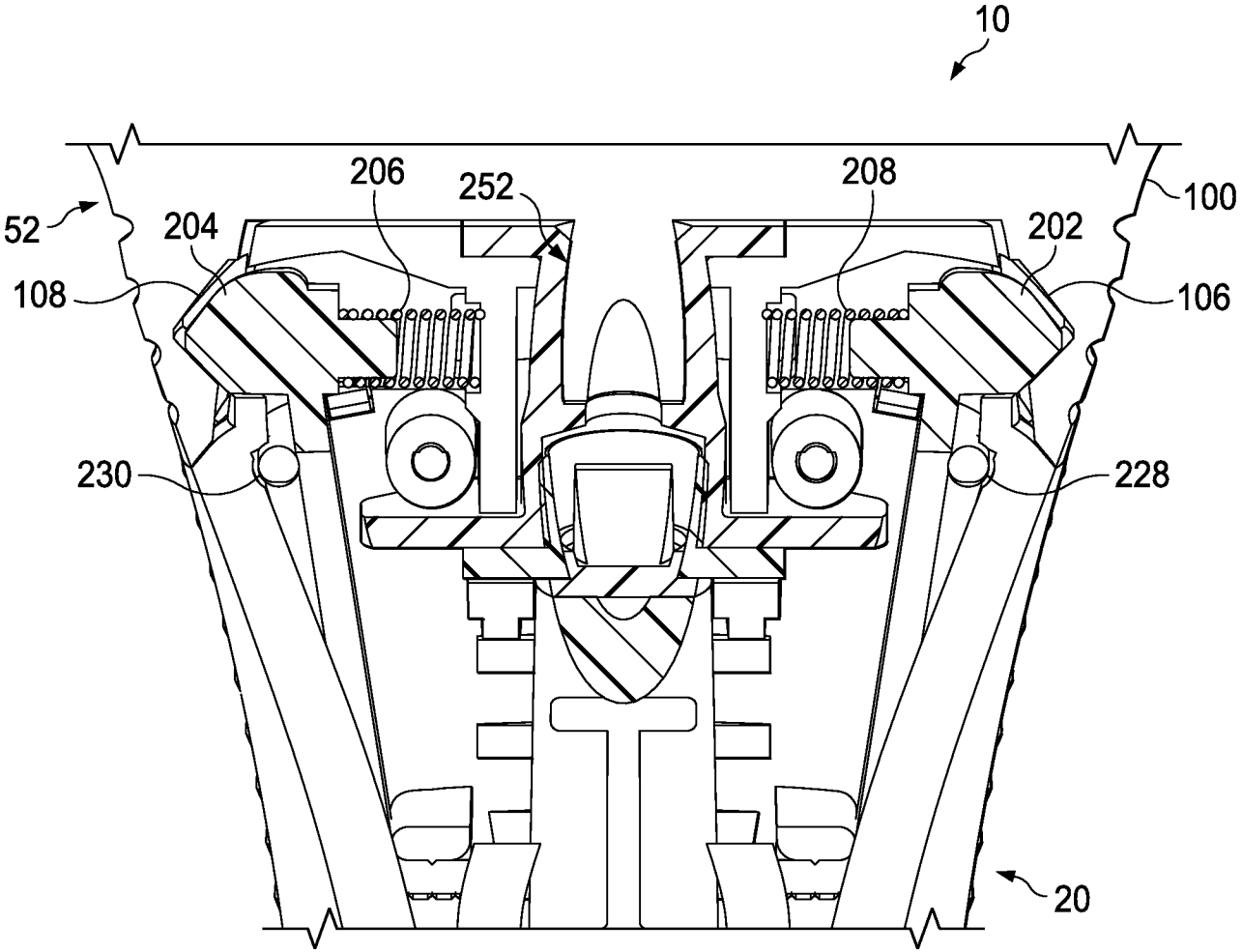
FIG. 5 is a partial front view of the personal-care appliance of FIG. 1.

The mechanical locking mechanism 200 (e.g., the engagement members 202 and 204) may be in the neural position when the fluid dispensing cartridge 50 is securely mounted to the handle 20 and/or the fluid dispensing cartridge 50 is removed from the handle 20. Referring to FIG. 5, a front partial view of the personal-care device 10 is shown illustrating the fluid dispensing cartridge 50 is securely mounted to the handle 20. One end (e.g., a portion) of the handle 20 may be positioned within the cavity 104 of the base member 100. The base member 100 (e.g., the wall 102) may force the engagement members 202 and 204 inward from the neutral position to the loading position. The engagement members 202 and 204 may release back outward into the neutral position as the engagement members 202 and 204 mate with the corresponding engagement surfaces 106 and 108 (e.g., the engagement members 202 and 204 may be positioned within the corresponding engagement surfaces 106 and 108) to secure the fluid interconnect member 52 to the handle 20. The consumer may detach the fluid interconnect member 52 (and thus the fluid dispensing cartridge 50) from the handle 20, by simply pulling the fluid dispensing cartridge 50 away from the handle. The base member 100 (e.g., the wall 102) may force the engagement members 202 and 204 from the neutral position to the loading position as the handle 20 is removed from the cavity 104 of the base member 100. The engagement members 202 and 204 may release back into the neutral position when the engagement members 202 and 204 no longer are in contact with the base member 100 of the fluid interconnect member 52.

Figure 6:
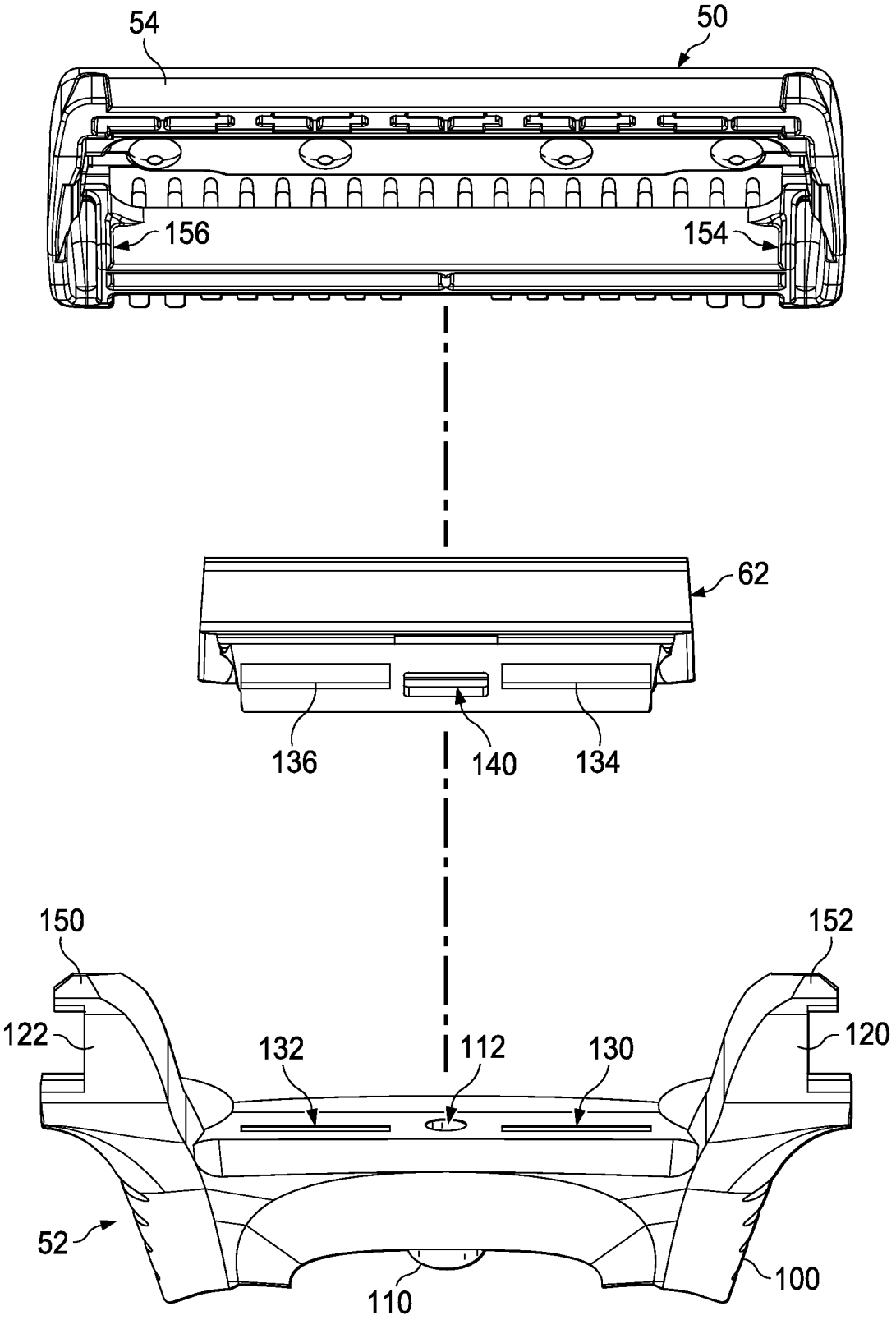
FIG. 6 is an assembly view of the fluid dispensing cartridge of FIG. 2.

Referring to FIG. 6, an assembly view of the fluid dispensing cartridge 50 is shown. In certain embodiments, the fluid applicator 62 may be joined to the base member 100 of the fluid interconnect member (e.g., injection molding, solvent bonding, ultrasonic welding, adhesives, press fitting, and/or snap fitting). The base member 100 of the fluid interconnect member 52 may have one or more alignment members 130 and 132 (e.g., one or more recesses and/or protrusions) that engage one or more corresponding alignment members 134 and 136 (e.g., one or more recesses and/or protrusions) of the fluid applicator 62. The fluid applicator 62 may define an opening 140 that is positioned between the alignment members 134 and 136. The opening 140 may extend through the fluid applicator 62. The alignment members 130, 132, 134 and 136 may facilitate proper positioning (i.e., alignment) of the opening 140 of the fluid applicator 140 with the aperture 112 of the fluid interconnect member 52. If the opening 140 and the aperture 112 are not oriented properly, fluid leakage may result.

Each of the pivotable support members 120 and 122 may have an engagement region 150 and 152 (e.g., an arm) that mates with a corresponding engagement region 154 and 156 (e.g., a recess) of the cartridge housing 54. In certain embodiments, the engagement region 150 and 152 may be retained to the corresponding engagement region 154 and 156 by snap fitting or other mechanical securing mechanisms. The fluid applicator 62 may be mounted to the cartridge housing 54 to facilitate pivoting of the cartridge housing 54 relative to the fluid interconnect member 52. The fluid applicator 62 may be mounted to the cartridge housing 54 after the fluid applicator 62 is secured to the fluid interconnect member 52. For example, the fluid applicator 62 may be injection molded to the fluid interconnect member 52 forming a unitary component. The cartridge housing 54 may then be mounted to the fluid interconnect member 52 as part of another manufacturing step.

Figure 7:
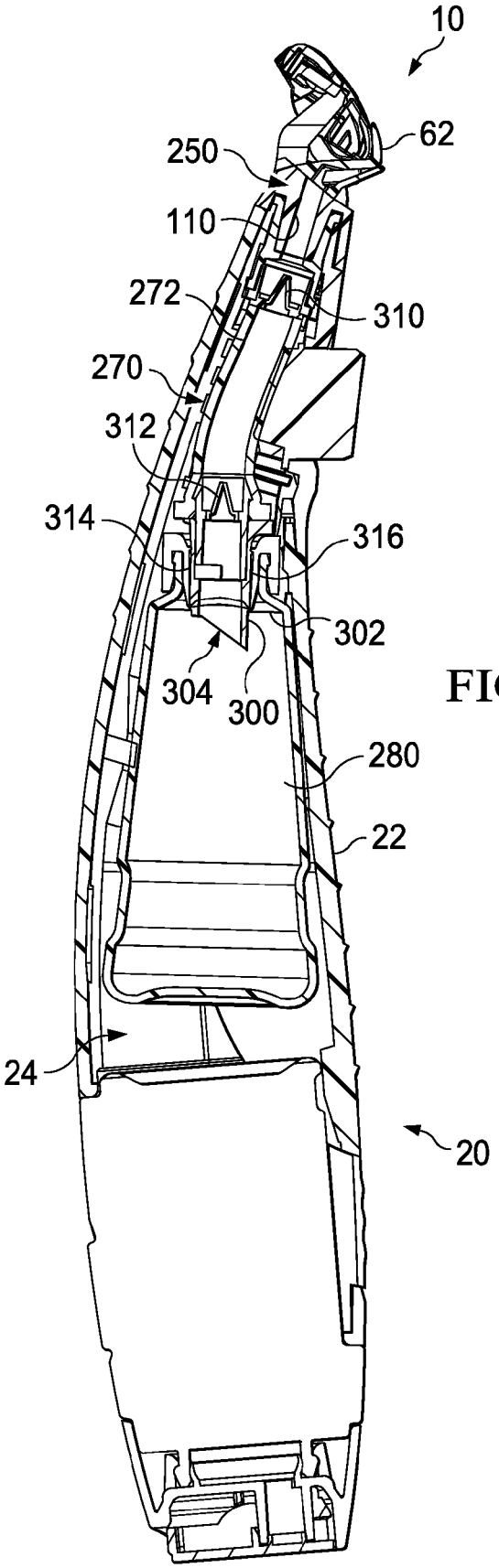
FIG. 7 is a cross section view of the personal-care appliance, taken generally along the line 7-7 of FIG. 1.

Referring to FIG. 7, a cross section view of the personal care appliance 10 is shown, taken generally along the line 7-7 of FIG. 1. The personal-care appliance 10 of FIG. 7 is shown with the fluid reservoir 280 a loaded position. The fluid reservoir 280 may be positioned within a cavity 24 of the handle 20. The cover 22 may conceal and/or protect the fluid reservoir 280 with the handle 20. The pump assembly 270 may include a fluid connector 300 that engages the fluid reservoir 280 to establish fluid connection (e.g., the fluid connector 300 may rupture a frangible seal 302 of the fluid reservoir 280). An outer wall 314 of the fluid connector 300 may seal against an inner wall 316 of the fluid reservoir 280 to prevent fluid from leaking into the handle 20. The actuator 12 (e.g., a button) may facilitate pumping of the fluid from the fluid reservoir 280 to the fluid applicator 62. For example, the actuator 12 may compress the resilient elastomeric tube 272 to open the first valve 310 and release a predetermined dosage of fluid to the fluid applicator 62. The actuator 12 may be released to return the resilient elastomeric tube 272 to its uncompressed state. The first valve 310 may close to prevent contamination and the second valve 312 may open to fill the resilient elastomeric tube 72 with fluid for the next release by the actuator 12. Accordingly, fluid may be directed within an opening 304 defined by the fluid connector 300, which is in fluid communication with the pump assembly 270 (e.g., elongated resilient tube 272) and ultimately the fluid applicator 62. The pump assembly 270 may include the elongated resilient tube 272 that pumps fluid from the fluid reservoir 280 and through a pair of valves 310 and 312. The fluid reservoir 280 may be held permanently within the handle 20. Thus, after the fluid within the fluid reservoir 280 is consumed, the consumer may dispose of the personal-care appliance 10. Alternatively, fluid reservoir 280 may be removed and replaced with a new fluid reservoir 280 after the fluid is consumed.

Figure 8:
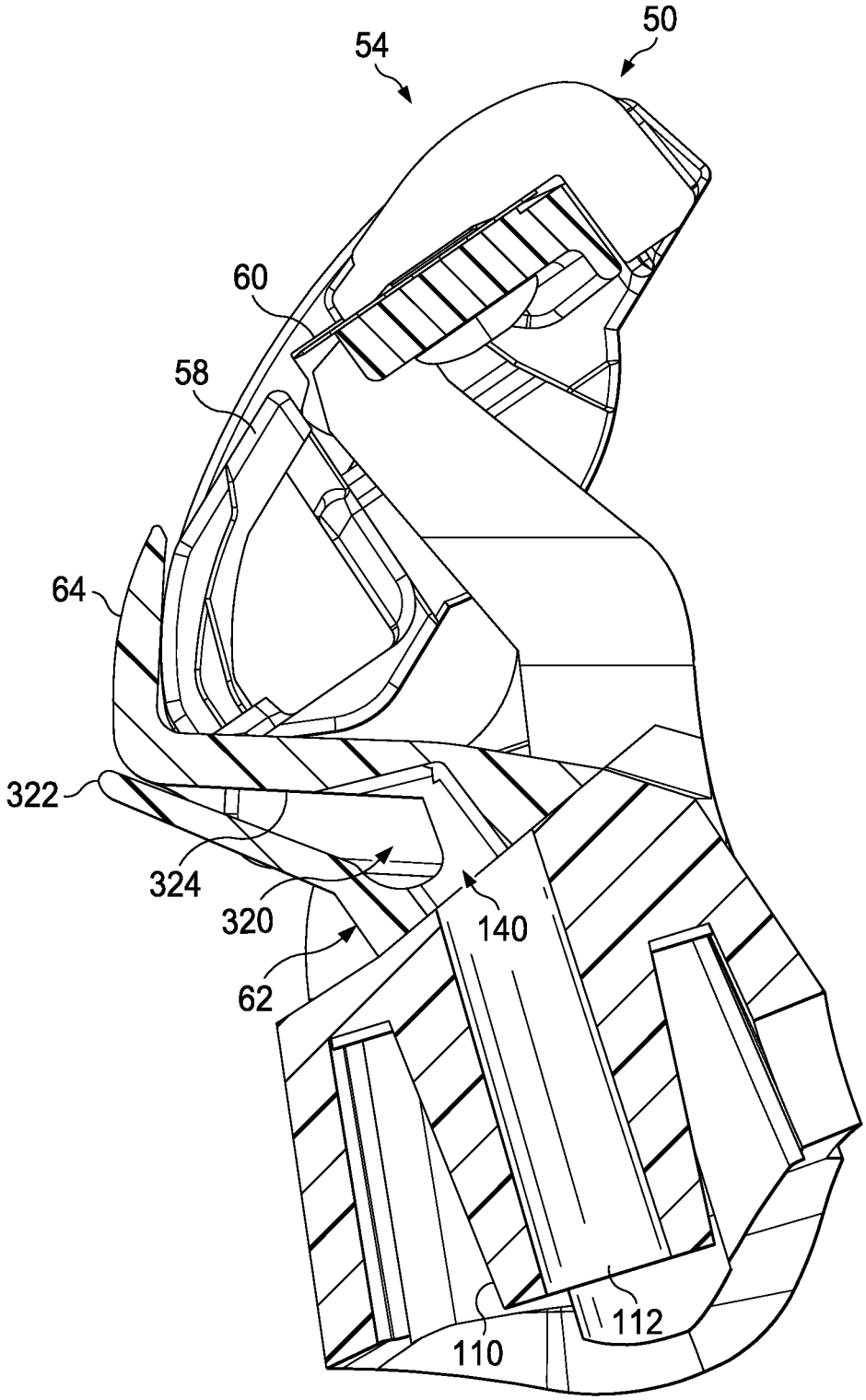
FIG. 8 is a cross section view of the fluid dispensing cartridge, taken generally along the line 8-8 of FIG. 6.

Referring to FIG. 8, a cross section view of the fluid dispensing cartridge 50, taken generally along the line 8-8 of FIG. 6 is shown. Fluid may be forced from the elongated resilient tube 272, through the first valve 319, and into the aperture 112 of the fluid port 110. The aperture 112 of the fluid port may be generally aligned (e.g., overlapping) with the opening of the fluid applicator 62 to facilitate the flow of fluid to an elongated recess 320. The elongated recess 320 may be defined by a front flap 322 and a rear wall 324 of the fluid applicator 62. The front flap 322 and/or the rear wall 324 may guide fluid toward the guard 64 of the fluid applicator 62. During a shaving stroke, the guard 64 may disburse fluid onto the surface being treated (e.g., area of the skin being shaved). The guard 64 may also direct fluid toward the guard 58 and/or blade 60 of the cartridge housing 54 to improve glide of the cartridge housing 54 across the skin during a shaving stroke.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm." Furthermore, dimensions should not be held to an impossibly high standard of metaphysical identity that does not allow for discrepancies due to typical manufacturing tolerances. Therefore, the term "about" should be interpreted as being within typical manufacturing tolerances.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A replaceable fluid dispensing cartridge for a liquid dispensing razor comprising:

a fluid interconnect member having a pivotable support member and a base member and a wall defining a cavity, within said cavity is a fluid port formed of a rigid polymeric material, said wall forming a pair of opposing engagement surfaces for removably and fixedly mating to a pair of slideabe corresponding engagement member of a handle which extend outwardly into said pair of opposing engagement surfaces, wherein each of said pair of engagement members comprises a biasing member, wherein each of said biasing members applies an outward opposing force onto each of said pair of engagement members such that said pair of engagement members engage said pair of engagement surfaces at a rest position, wherein said port is positioned between said pair of opposing engagement surfaces;

a cartridge housing mounted to the pivotable support member, the cartridge housing having a guard, a cap, and at least one blade between the cap and the guard;

a fluid applicator defining an opening, wherein one end of the fluid applicator is mounted to the cartridge housing and an opposing end of the fluid applicator fixedly joined to the fluid interconnect member.

2. The replaceable fluid dispensing cartridge of claim 1 wherein the fluid applicator comprises a guard positioned on top of the guard of the cartridge housing.

3. The replaceable fluid dispensing cartridge of claim 1 wherein the base member has a wall that defines a cavity configured to receive at least a portion of a handle.

4. The replaceable fluid dispensing cartridge of claim 3 wherein the engagement surface is on the wall of the base member.

5. The replaceable fluid dispensing cartridge of claim 1 wherein the fluid port comprises a stem extending from the base member.

6. The replaceable fluid dispensing cartridge of claim 1 wherein the fluid applicator comprises a resilient elastomeric material.

7. The replaceable fluid dispensing cartridge of claim 1 wherein the pivotable support member comprises a pair of outwardly extending arms.

8. The replaceable fluid dispensing cartridge of claim 1 wherein the fluid interconnect member comprises one or more alignment members.

9. The replaceable fluid dispensing cartridge of claim 8 wherein the alignment member of the fluid interconnect member engages one or more corresponding alignment members of the fluid applicator.

10. The replaceable fluid dispensing cartridge of claim 1 wherein the fluid port defines an aperture extending through the fluid interconnect member.

11. The replaceable fluid dispensing cartridge of claim 10 wherein the fluid applicator defines an opening that is generally aligned with the aperture of the fluid interconnect member.

12. The replaceable fluid dispensing cartridge of claim 1 wherein the fluid port is aligned with the opening of the fluid applicator.

13. The replaceable fluid dispensing cartridge of claim 1 wherein the pair of opposing engagement surfaces each form a receiving cavity to receive a respective engagement member in the form of a protrusion extending outwardly from said fluid port.

* * * * *